United States Patent [19]

Andersson et al.

[11] 4,259,141

[45] * Mar. 31, 1981

[54] APPARATUS FOR APPLICATION OF A TAPE OF INSULATING MATERIAL IN THE LONGITUDINAL DIRECTION OF A SUBSTANTIALLY RECTANGULAR ELECTRICAL CONDUCTOR

[75] Inventors: Gunnar Andersson; Gunnar Borgstrom, both of Vesteras, Sweden

[73] Assignee: ASEA Aktiebolag, Vesteras, Sweden

[ * ] Notice: The portion of the term of this patent subsequent to Jul. 3, 1996, has been disclaimed.

[21] Appl. No.: 937,216

[22] Filed: Aug. 28, 1978

Related U.S. Application Data

[62] Division of Ser. No. 789,836, Apr. 22, 1977, Pat. No. 4,159,920.

[51] Int. Cl.[3] ..... H01B 13/00

[52] U.S. Cl. ..... 156/438; 156/463; 156/468

[58] Field of Search ..... 156/53, 54, 55, 201, 156/202, 275, 306, 322, 499, 461, 463, 467, 468, 199, 200, 438; 174/117 FF

[56] References Cited

U.S. PATENT DOCUMENTS

| | | | |
|---|---|---|---|
| 3,527,667 | 9/1970 | Larsen et al. | 156/322 |
| 3,723,797 | 3/1973 | Andersson et al. | 174/117 FF |
| 3,775,628 | 11/1973 | Andersson et al. | 310/208 |
| 3,777,198 | 12/1973 | Anderson et al. | 310/200 |
| 3,989,561 | 11/1976 | Cotton | 174/117 FF |

FOREIGN PATENT DOCUMENTS 1233862 6/1971 United Kingdom .

*Primary Examiner*—Michael W. Ball

*Attorney, Agent, or Firm*—Watson, Cole, Grindle & Watson

[57] ABSTRACT

In apparatus for application of a tape of insulating material provided with a heat fixing binder to a substantially elongated rectangular electrical conductor in the longitudinal direction thereof, the conductor is heated, a portion of the tape is contacted with the first side of the conductor and other portions of the tape are successively contacted with other respective sides of the conductor. The successive contacting stations after the first contacting station each include apparatus for folding a portion of the tape about an edge of the conductor and then contacting a portion of the tape with a side of the conductor including that edge. The conductor may be additionally heated after several folding and contacting operations, and pressure may be applied to the conductor and tape after the tape has been completely fixed to the conductor.

7 Claims, 9 Drawing Figures

APPARATUS FOR APPLICATION OF A TAPE OF INSULATING MATERIAL IN THE LONGITUDINAL DIRECTION OF A SUBSTANTIALLY RECTANGULAR ELECTRICAL CONDUCTOR

This is a division of application Ser. No. 789,836 filed Apr. 22, 1977, now U.S. Pat. No. 4,159,920.

BACKGROUND OF THE INVENTION

1. Field of the Invention

The invention relates to the manufacture of insulated electrical conductors, and more particularly to apparatus for application of insulating tape along the longitudinal direction of substantially rectangular cross-section electrical conductors.

2. Prior Art

U.S. Pat. No. 3,723,797, 3,777,198 and 3,775,628 describe rectangular electrical conductors on which tapes of corona-resistant insulating material and/or tape-formed polymer film have been applied by arranging the tape or film along the longitudinal direction of the conductor. The tape is then folded around the edges of the conductor and is fixed to the underlying material by means of a binder which has been applied to the tape prior to its application to the conductor. The insulating tape is folded around the edges of the conductor and fixed to the underlying material in the manner described above.

SUMMARY OF THE INVENTION

According to the invention it is possible to efficiently and continuously obtain conductors insulated with insulating tape, in which the tape insulation is practicially free from blisters and has a well-defined, predeterminable geometry and location on the conductor.

It is an important feature of the present invention that the conductor is heated before the insulating tape is brought into contact therewith so that the conductor provides the required heating of the binder on the insulating tape. Thereby the binder is heated only on that part of the insulating tape which, at each moment of the application of the insulating tape, is in contact with the conductor. It is a further important feature of the invention that only part of the insulating tape is first fixed to the conductor before the other parts of the tape are fixed thereto. This enables the tape to have a definite location on the conductor and prevents sliding movements of the tape relative to the conductor, which movements are hard to avoid if the parts of the tape are fixed around the conductor simultaneously. The successive fixing of the parts of the tape also makes it possible to fold the tape around the conductor in a substantially blister-free manner. The heating is preferably performed by induction heating since such heating is easily carried out so quickly that no formation of blisters occurs in the layer of a varnish or a polymer film on the conductor. And also no harmful oxide formation occurs if the conductor lacks such a layer. According to one embodiment of the invention an additional heating of the conductor is performed after the insulating tape has been applied on one or more sides of the conductor. In this way the first heating can be limited so that the risk of the previously mentioned damage is avoided to an even greater extent.

As stated above, the insulating tape can be applied directly to the conductor or to a conductor which is already insulated, for example, with a varnish or a polymer film. The varnish can then be of such a type as is normally used for varnishing winding wire such as, for example, terephthalic acid alkyds, polyester imides, polyamide imides, polyimides, polyurethanes, silicones and epoxy resins. The polymer in the polymer film may, among other things, consist of a linear unbranched or branched polymer such as, for example, polyamide imide, polyimide, a polymer based on polyhydantoin, polyethylene glycol terephthalate, polycarbonate and polysulphon. According to the present invention, the polymer film can be applied in the longitudinal direction of the conductor and folded around the edges of the conductor. It is also possible to spin the film around the conductor. At least in the latter case another insulating tape is applied on top of the polymer film in the longitudinal direction of the conductor.

Other examples of insulating tapes which are suitable for application according to the present invention are among other things, besides the polymer film, different kinds of mica tapes, for example a tape built up of a mixture of small mica flakes ($<5$ mm$^2$) and short fibers of a linear polymer, such as polyamide, of cellulose or glass, or a tape built up from small flakes of mica only. Also insulating tapes of paper, for example, can be used for insulation of conductors according to the present invention.

The binder, which is applied to the insulating tape before the tape is applied to the conductor, should be dry before coming into contact with the conductor. Examples of suitable binders are flexible polyurethane resins, epoxy resins modified with polyamides, polyester resins modified with isocyanates, epoxy resins modified with polyurethane resin and certain types of rubber.

BRIEF DESCRIPTION OF THE DRAWINGS

The invention is described in greater detail by way of exemplary embodiments with reference to the accompanying Figures wherein.

DETAILED DESCRIPTION

Figure 1:
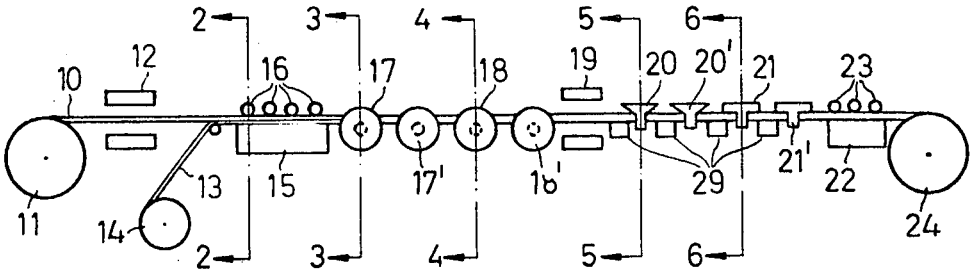
FIG. 1 shows a diagrammatic side view of apparatus according to the present invention.

With reference to FIG. 1, a rectangular copper conductor 10, for example having a width of 8 mm and a thickness of 3 mm, which may be uninsulated or provided with an insulation such as in the form of a varnish layer of, for example, terephthalic acid alkyd or in the form of a film of, for example, polyamid imide, is conveyed from a storage roller 11 through an induction coil 12, where it is heated to a temperature of around 300° C. An insulating tape 13, for example having a width of 20 mm and a thickness of 75 microns, and made from a mixture of equal parts by weight of small mica flakes and short fibers of an aromatic amide (e.g. NOMEX M from Du Pont, U.S.A.). On one side the tape 13 is coated with a thin layer of a binder consisting of, for example, a polyamide-modified epoxy resin (such as "AF-42" from Minnesota Mining and Manufacturing Company, U.S.A.). Tape 13 is conveyed towards the conductor from storage roller 14 with the binder side of the tape facing the conductor.

Figure 2:
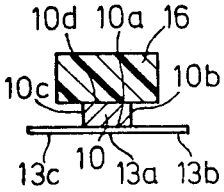
FIGS. 2 to 6 are cross-sectional views of apparatus for sequentially applying tape to a conductor with the sectional views being taken along lines 2—2, 3—3, 4—4, 5—5, and 6—6, respectively, at the indicated stages of the apparatus of FIG. 1 in accordance with one embodiment of the invention.
Figure 3:
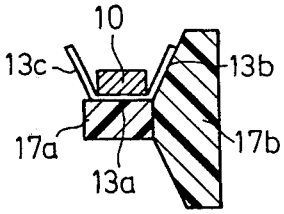

With reference to FIG. 2, the middle portion 13*a* of insulating tape 13 is brought into contact with a first conductor side 10*a* and is fixed to that conductor side in a device comprising a plane table 15 and rollers 16 which are held pressed against the upper side of the conductor by means not shown in the Figures. The pressure is effected, as is the case with the rollers described, infra, by spring forces acting on the shafts of the rollers. The rollers may advantageously be made of a plastic such as polytetrafluoro ethylene, possibly surrounded by a shell of metal. Securing of the middle portion 13*a* of tape 13 is obtained because the binder, which is dry from the beginning, melts at the middle tape portion 13*a* by the heat from the conductor, and then hardens. With continuing reference to FIG. 2 and additional reference to FIG. 3, each of tape portions 13*b* and 13*c*, extending on respective sides of conductor 10, is then folded around the edge of the conductor which is located between first conductor side 10*a* and adjacent conductor sides 10*b* and 10*c*, respectively, with a number of rollers 17, 17' (which are located on one side of the conductor and are shown in FIG. 1), and with rollers 18, 18' as described, infra. Rollers 17, 17' each have a cylindrical portion 17*a* located beneath middle portion 13*a* of tape 13, and a conical surface 17*b* for folding tape portion 13*b*. In the first of rollers 17 engaged by tape 13 and conductor 10, concical surface 17*b* forms a greater angle with side 10*b* than the corresponding conical surface of the other subsequently engaged roller 17'. On the other side of tape 13 and conductor 10 there are a pair of rollers (not shown) corresponding to rollers 17, 17' for folding part 13*c* of the tape, which rollers are displaced in position in the direction of movement of the conductor in relation to rollers 17, 17'. Also with regard to rollers 18, 18', 20, 20' and 21, 21' described, infra, only the rollers located on one side of the conductor are shown in FIG. 1. Rollers 17, 17', 18, 18', 20, 20' and 21, 21' comprise means for subsequently successively contacting other portions of the tape with other respective sides of the conductor. There are also rollers, corresponding to those shown, on the other side of the conductor and such rollers perform the same tasks as the shown rollers regarding the parts of insulating tape 13 which are located on the other side of conductor 10. The rollers on the other side of the apparatus have not been shown to avoid cluttering the drawing. Moreover, as such rollers perform identical functions to the shown rollers, there is no need to provide a description of their operation for purposes of practicing the invention.

Figure 4:
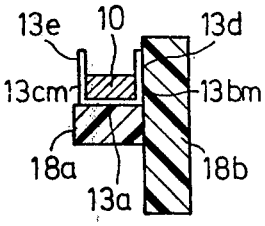

With additional reference to FIG. 4, tape portions 13*bm* and 13*cm*, respectively, of tape portions 13*b* and 13*c*, respectively, located nearest the middle portion, are then fixed to the conductor by a number of rollers 18, 18' which also contribute to the folding of the tape portions 13*bm* and 13*cm*. Rollers 18, 18' each have a cylindrical part 18*a* supporting the middle portion 13*a* of tape 13 and conductor 10, and a part 18*b* (second means for contacting and fixing) with a surface parallel to the conductor and pressing against it as shown in FIG. 4. The fixation of tape portion 13*bm* to conductor 10 is achieved by the binder on part 13*bm* being heated by conductor 10. Rollers (not shown) corresponding to rollers 18, 18' on the other side of conductor 10, fold and fix part 13*cm* in a corresponding way. After passing through rollers 18, 18', conductor 10 and tape 13 pass through an induction coil 19 (second means for folding) for additional heating of the conductor.

Figure 5:
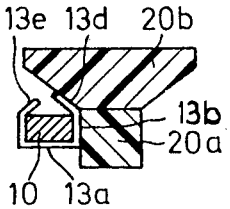
Figure 6:
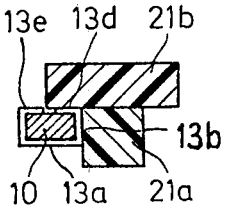

As shown in FIG. 5, each of tape portions 13*d* and 13*e* extending above conductor sides 10*b* and 10*c*, respectively, is thereafter folded around a respective edge of conductor 10 which is located between a side 10*b* and 10*c* onto conductor side 10*d*, opposite to the side 10*a*, by a number of rollers 20, 20' (second means for folding) and 21, 21' as described, infra. Rollers 20, 20' (third means for contacting and fixing) each have a cylindrical part 20*a* engaging tape portion 13*b* on conductor side 10*b* and an upstanding part 20*b*, with a conical surface 20*c* confronting tape portion 13*d* in contacting relation therewith as shown in FIG. 5. In rollers 20, conical surface 20*c* forms a greater angle with conductor side 10*d* than the corresponding conical surface of rollers 20'. Rollers (not shown) on the other side of conductor 10 fold part 13*e* of the tape in a corresponding way and are staggered along the conductor with respect to rollers 20, 20'. Tape portions 13*d* and 13*e* are then additionally folded and fixed to conductor side 10*d* with rollers 21, 21'. Rollers 21, 21' each have a cylindrical part 21*a* in contacting relationship to tape portion 13*b* conductor side 10*b* and a part 21*b* with a surface parallel to and confronting conductor side 10*d* to press tape portion 13*d* against conductor side 10*d* as shown in FIG. 6. The fixation of tape 13 is effected by the binder on tape portion 13*d* being heated by conductor 10. Rollers (not shown) on the other side of conductor 10 fold and fix part 13*e* in a corresponding way, and are staggered along the conductor with respect to rollers 21, 21'. A number of supports 29 are arranged to support conductor 10 in front of and between rollers 20 and 21. Supports 29 bear against the downwardly-directed pressure on conductor 10 exercised by rollers 20, 20' and 21, 21'. The conductor with the applied tape finally passes over plane table 22 and beneath a number of rollers 23 of the same type as the rollers 16 before it is wound up on wind-up device 24. It is also possible, of course, after fixing middle tape portion 13*a*, to first fold and fix parts 13*b* and 13*d* before parts 13*c* and 13*e* are folded and fixed. In such a case, all rollers on the other side of conductor 10 and corresponding to rollers 18, 18', 20, 20' and 21, 21' are positioned after rollers 21, 21' in the direction of transport of conductor 10 in the apparatus shown in FIG. 1.

Figure 7:
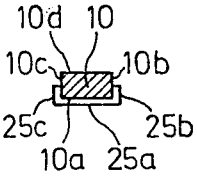
FIGS. 7, 8 and 9 illustrate alternative apparatus for applying insulating tape to an electrical conductor according to the present invention.

FIG. 7 shows application of tape 25, which is narrower than tape 13, onto conductor 10 utilizing the invention. In this case, tape portion 25*a* is first fixed to conductor side 10*a* and then tape portions 25*b* and 25*c* are folded and fixed to conductor sides 10*b* and 10*c*. It is, of course, possible to apply a similar tape on conductor side 10*d* and the upper parts of conductor sides 10*b* and 10*c*.

Figure 8:
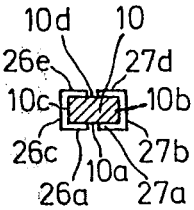

FIG. 8 shows another way of applying two tapes 26 ad 27, respectively, to conductor 10 in accordance with the invention. With regard to tape 26, tape portion 26*a* is first fixed to conductor side 10*a* and thereafter tape portions 26*c* and 26*e* are fixed in turn to conductor sides 10*c* and 10*d*. The tape 27 is fixed to conductor 10 simultaneously with, or after, tape 26 with tape portions 27*a*, 27*b* and 27*d* fixed in turn to conductor sides 10*a*, and 10*b* and 10*d*, respectively.

Figure 9:
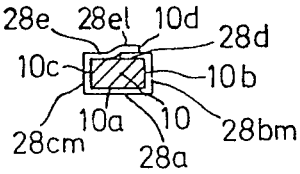

FIG. 9 shows the application of a broader tape 28 than tape 13 onto conductor 10 utilizing the invention. In this case, tape portions 28*a*, 28*bm*, 28*cm* and 28*d* can be applied in the manner previously described with respect to FIGS. 1 to 6. Tape portion 28*e* is applied after tape portion 28*d*, and its fixation to conductor 10 takes place by heat from the conductor upon contact therewith and with tape portion 28*d*, respectively, at the overlapping tape portion 28*el*.

The apparatus for moving the conductor through the tape applying apparatus does not form any part of the invention per se, and those skilled in the art will recognize that any well-known conveying techniques can be employed to transport the conductor and tape through the tape applying apparatus. In the embodiments described above, the tape and conductor are moved through the tape applying apparatus by rotation of the wind-up device 24.

What is claimed is:

1. Apparatus for application of a tape of insulating material provided with a heat-fixing binder to a substantially elongated rectangular electrical conductor in the longitudinal direction thereof by a series of successively positioned operating stations, comprising:

first means for heating said conductor;

means for contacting a portion of said tape with a first side of the conductor subsequent to the heating thereof to fix said tape portion to said conductor;

means for subsequently successively contacting in turn other portions of the tape with other respective sides of the conductor;

second means for heating said conductor and being located after said first means for contacting and before the last one of said means for subsequently successively contacting in the direction of movement of said conductor and tape; and means for moving said conductor through said first and second means for heating, and for moving said conductor and said tape through said means for contacting, and said means for successively contacting.

2. Apparatus as in claim 1 wherein said means for successively contacting includes first means for folding at least one uncontacted end tape portion around at least one conductor edge, said at least one edge being adjacent said first conductor side; second means for contacting and fixing said at least one folded tape portion to at least one other conductor side; second means for folding the remaining uncontacted end tape portion around at least another conductor edge contiguous with said at least one other conductor side; and third means for contacting and fixing said folded remaining tape portion to another conductor side.

3. Apparatus as in claim 3 wherein said second means for heating said conductor is located between said second means for contacting and said second means for folding.

4. Apparatus as in claim 3 further comprising means for applying pressure to said conductor and tape and being located beyond said third means for contacting in the direction of movement of said conductor and tape through said apparatus.

5. Apparatus as in claim 3 wherein said first and second means for folding and said second and third means for contacting each include at least two consecutively located roller members.

6. Apparatus as in claim 5 wherein said first contacting means includes a table for supporting said tape and conductor and at least one roller member positioned in spaced relationship to said table for pressing said tape and conductor in contacting relationship with one another, said at least two roller members of said first and second means for folding each including means for supporting said tape and conductor and means having a conically-shaped surface contiguous to an end of said member for folding said tape; and said at least two roller members of said second and third means for contacting each including second means for supporting said conductor and tape and second means substantially perpendicular to said second means for supporting to contact and fix said tape to said conductor.

7. Apparatus as in claim 6 wherein said second means for heating said conductor is located between the last-positioned roller member of said second means for contacting and the first-positioned roller member of said second means for folding, and further comprising means for applying pressure to said conductor and tape and being located after the last roller member of said third contacting means, the location of the aforesaid elements being determined in the direction of movement of said conductor and tape through said apparatus.

* * * * *